United States Patent [19]

Swainson

[11] 4,044,807

[45] Aug. 30, 1977

[54] PIPE TOBACCO TAMPER AND METHOD

[76] Inventor: Ralph V. Swainson, 238 16th St., NE., Winter Haven, Fla. 33880

[21] Appl. No.: 596,978

[22] Filed: July 18, 1975

Related U.S. Application Data

[63] Continuation-in-part of Ser. No. 544,877, Jan. 29, 1975, abandoned.

[51] Int. Cl.[2] ..... A24F 3/02; A24F 9/02

[52] U.S. Cl. ..... 131/243; 131/247

[58] Field of Search ..... 131/243, 247, 177, 184

[56] References Cited

U.S. PATENT DOCUMENTS

| | | | |
|---|---|---|---|
| 734,295 | 7/1903 | Blanpied | 131/247 |
| 1,001,242 | 8/1911 | Berg | 131/247 X |
| 1,019,028 | 3/1912 | Dodge | 131/243 |
| 1,519,955 | 12/1924 | Cuilla et al. | 131/247 |
| 1,689,226 | 10/1928 | Brown | 131/247 X |
| 2,256,848 | 9/1941 | Pokorny | 131/247 X |
| 2,274,386 | 2/1942 | Simpson | 131/177 X |
| 3,672,374 | 6/1972 | Mancuso | 131/243 |
| 3,853,132 | 12/1974 | Patton | 131/247 |
| 3,918,463 | 11/1975 | Lebert | 131/247 X |

*Primary Examiner*—Stephen C. Pellegrino
*Attorney, Agent, or Firm*—Fulbright & Jaworski

[57] ABSTRACT

A pipe tamper for and a method of tamping tobacco in a pipe bowl is disclosed. The pipe tamper includes a handle, preferably detachable, and a tamping head of a size to fit within the pipe bowl and having a face at an angle of from about 10° to about 65°, and preferably 22.5°, to a plane extending through the tamping head thereby providing an angled face with a leading edge and trailing edge. Preferably, the handle is detachable and includes a pick which may be used to clean tobacco ashes from the pipe bowl.

The method comprises tamping the tobacco's upper surface adjacent inner sides of the bowl generally into a compressed outer ring substantially devoid of air pockets and leaves the central portion with air pockets which provide a slower burning central portion and a faster burning outer ring resulting in a substantially even burn from the outside to the inside. Preferably, to make the pack continuously correctly packed from top to bottom, the pipe bowl is partially filled with tobacco, about half full, then tamped as indicated previously, then the pipe bowl is filled to the top with additional tobacco and tamped in the same manner and additional tobacco is added and again tamped in the same manner. The upper surface of the tobacco is then lit with a fire and again tamped as indicated thereby pressing down the ash so that it acts to "coke" the fire and also filters the smoke which is accomplished by the fine ash falling through the air pockets or spaces in the unburned tobacco.

10 Claims, 5 Drawing Figures

Fig. 1
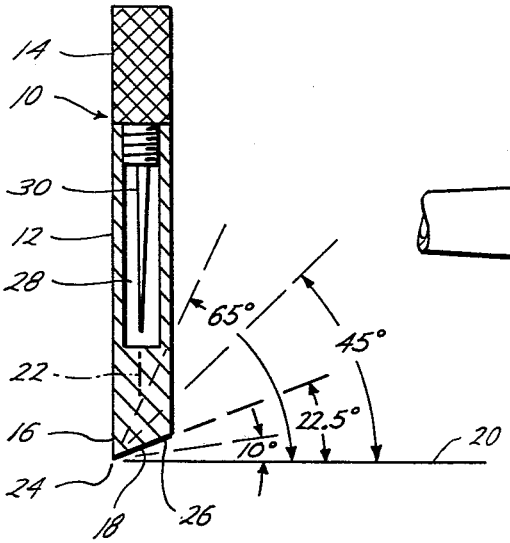
Fig. 2
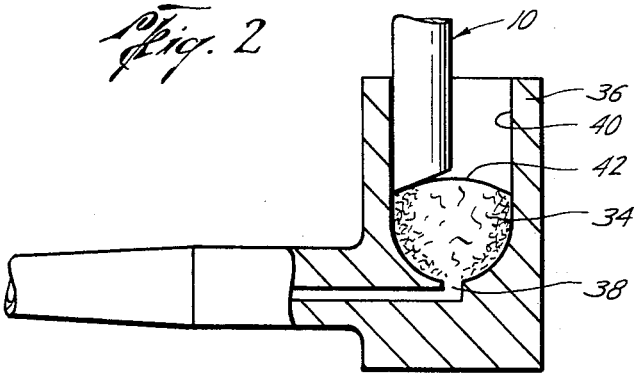
Fig. 3
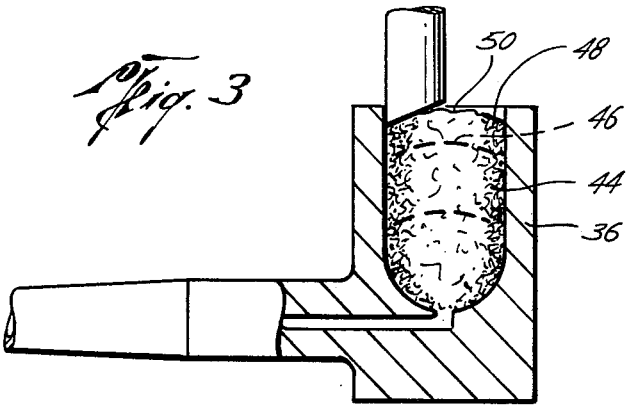
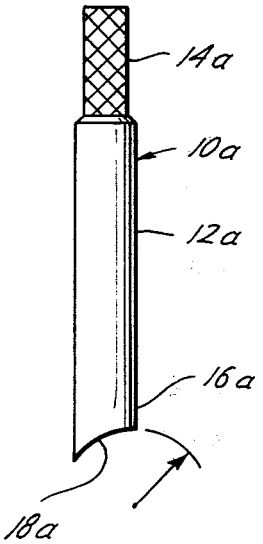
Fig. 5
Fig. 4
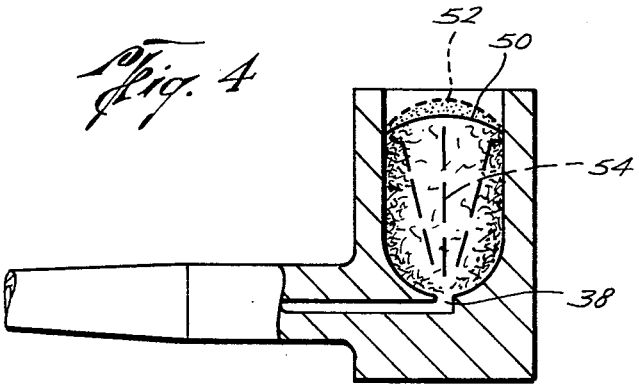

PIPE TOBACCO TAMPER AND METHOD

CROSS-REFERENCE TO RELATED APPLICATION

This application is a continuation-in-part application of my co-pending application, Ser. No. 544,877, filed Jan. 29, 1975, now abandoned.

BACKGROUND OF THE INVENTION

A universal problem of pipe smokers is obtaining the proper pack of tobacco in the pipe bowl. Tobacco when placed in the pipe bowl and simply tamped down have most air pockets removed in the tobacco generally throughout the tobacco resulting in equally compressed tobacco throughout the bowl. This results in tunneling, uneven burning, wetness, and often the bitterness in pipes.

While there have been a number of pipe tampers suggested for use and used in the past, none of them provides the unique tamping and improved results of my invention. For example, U.S. Pat. No. 1,019,028 illustrates a pipe tamper with a concave tamping surface, but this tamper while providing a convex or dome-like surface compresses and packs the tobacco throughout the pipe bowl, rather than compressing the tobacco just around the outer rim. Similarly, tampers disclosed in U.S. Pat. Nos. 734,295; 1,001,242; 1,519,955; 1,689,226; 2,274,386; 3,853,132; and 3,672,374 compress the tobacco throughout the pipe bowl and not about the rim, leaving the center portion uncompressed. It would be highly advantageous to provide a pipe tamper and a method of tamping tobacco in a pipe which provides an even burn that allows the tobacco to burn into a fine white ash, from the top of the bowl to the very last portion of tobacco, which prevents tunneling and heeling and the wetness and bitterness resulting therefrom.

SUMMARY

The foregoing problems of the prior art are solved and the advantages obtained by a tamper which has a handle and a tamping head having a face at an angle from about 10° to about 65° to a plane extending at a right angle to a line extending longitudinally through the head providing an angled face having a leading edge and a trailing edge. The head is of a size small enough to fit within the pipe bowl and should not cover more than about 50% of the tobacco surface. Preferably, the angle of the face is about 22.5% and the handle is detachable and includes a concealed pick for cleaning the pipe bowl.

It is therefore an object of the present invention to provide a pipe tamper having a tamping head disposed at an angle to a longitudinal line extending through it, having a leading edge and a trailing edge with its tamping surface not covering more than about 50% of the tobacco surface so that the tamping head can tamp the tobacco in the pipe bowl in an outer compressed ring substantially devoid of air pockets and leave air pockets in a central portion and provide a convex upper surface to insure an even burn from all points on its surface by tamping the tobacco around the inner surface of the pipe bowl with the leading edge.

A still further object of the present invention is the provision of such a tamper which has such a tamping surface or face at an angle of from about 10° to about 65° to a plane extending at a right angle to a line extending longitudinally through the tamper head.

The foregoing problems of the prior art are also solved and the advantages are obtained by a method which comprises tamping the upper surface of tobacco in a pipe bowl having a draw opening around and adjacent the inner surface of the bowl into a compressed outer ring with substantially uncompressed inner portion substantially devoid of air pockets at the outer ring while having air pockets present in the tobacco's central portion. Secondarily, the surface should be dome-shaped so that arcs extending from the draw opening to points of the upper surface of the dome are substantially equidistant, thereby providing an even draw and thus an even burn thereby eliminating tunneling, heeling, wetness and bitterness.

The method includes partially filling the pipe bowl with tobacco and tamping as indicated, then adding additional tobacco and again tamping as indicated, and if desired, then completing the filling of the pipe bowl with tobacco and again retamping as indicated. The dome like upper surface of the tobacco is then lit, and, preferably, again tamped as indicated to "coke" the ashes at the upper surface of the tobacco.

Accordingly, it is a further object of the present invention to provide a method of tamping tobacco in a pipe bowl having a draw opening in which the tobacco's upper surface is tamped around and adjacent the pipe bowl's inner surface generally into a compressed outer ring substantially devoid of air pockets with a substantially uncompressed central portion having air pockets present in the tobacco thereby providing a slow burning central portions and a fast burning outer portion and thus preventing tunneling, heeling, wetness and insuring a substantially even burn from all points of the tobacco's surface.

A further object of the present invention is the provision of a method of tamping tobacco in a pipe bowl having a draw opening so that the tamping results in an upper surface is in the shape of a dome in which arcs extending from the draw opening to points of the dome surface are substantially equidistant, thereby providing a substantially even draw and thus burn and avoiding tunneling, heeling, wetness and bitterness.

A still further object of the present invention is the provision of a method of tamping tobacco in a pipe bowl in which the pipe bowl is partially filled with tobacco, then tamped around its outer ring, then additional tobacco is added, and retamped as indicated above, and, if desired, still additional tobacco added and retamped as indicated to provide a compressed outer ring of tobacco substantially devoid of air pockets and a substantially uncompressed central portion having air pockets thereby providing a slow burning central portion and a fast burning outer portion thus insuring a substantially even burn from all points of the tobacco's surface.

Other and further objects, features, advantages and details of the pipe tamper and the method of tamping are disclosed in the Abstract, the Background of the Invention, the accompanying drawings, in the Description of the Preferred Embodiments, and the claims.

BRIEF DESCRIPTION OF THE DRAWINGS

FIG. 1 is an elevational view, partly in section, of a pipe tamper according to the invention.

FIG. 2 illustrates the pipe tamper tamping tobacco partially filling a pipe bowl.

FIG. 3 is a view similar to FIG. 2 and illustrates the pipe tamper of FIG. 1 tamping additional tobacco placed in the pipe bowl.

FIG. 4 illustrates the tamped tobacco in the pipe bowl after it has been lit and retamped, and FIG. 5 is an elevational view of a modification of the pipe tamper of FIG. 1.

DESCRIPTION OF THE PREFERRED EMBODIMENTS

Referring to the drawing, and particularly to FIG. 1, the pipe tamper 10 includes a body portion 12, here shown in the form of a shank, a detachable handle 14 which is threaded or otherwise releasably secured to the body 12, and the tamping head 16 having the tamping face 18.

The tamping face 18 is disposed at an angle of from about 10° to about 65° to a plane 20 which extends at a right angle to a line 22 extending longitudinally through the tamper head 16. Preferably, the angle is about 22.5° and the face 18 is planar or lies in a single plane. This provides a leading edge 24 and trailing edge 26 on the tamping face 18. In order to compress the outer ring of tobacco and leave the central portion substantially uncompressed or less compressed the tamping face should not cover more than about 50% of the tobacco surface.

An alternate embodiment is illustrated in FIG. 5, to which reference is now made, and in which the reference letter *a* has been added to numerals designating corresponding parts to those of the pipe tamper of FIG. 1. This embodiment is substantially the same as that of FIG. 1 except that the handle 14*a* and the body 12*a* are all in one piece, the body 12*a* is enlarged, and the face 18*a* of the tamping head 16*a* is convex as described by the arc as illustrated.

Thus, the tamper 10 may take a variety of shapes and forms, may have detachable or integral parts, as desired.

The tamper may be made of a variety of materials, for example any of the metals, such as brass, aluminum, and the like, as well as various plastics, such as a thermosetting plastic, which will withstand the conditions of use, and preferably, which can be used to tamp the upper surface of the tobacco when burning.

In using the pipe tamper 10, and referring now to FIG. 2, tobacco 34 is placed in the pipe bowl 36 having the draw opening 38 at its lower portion. Preferably, an amount of tobacco 34 is put in the pipe bowl 36 to half fill it and the tamper 10 is then placed in the pipe bowl 36 with the leading edge 24 adjacent the inner surface 40 of the pipe bowl 36 and tamped while moving it around inside the pipe bowl. This compresses the outer ring of tobacco making it substantially devoid of air pockets while leaving the inner central portion substantially uncompressed or less compressed and having air pockets present. This tamping results in a convex or dome-like surface 42 of the tobacco.

If preferred, the pipe bowl 36 may be substantially filled with tobacco 34 and tamped only once; however, preferably and as illustrated in FIG. 2, the pipe bowl 36 is partially filled with tobacco 34, about one-half full, and tamped as indicated to compress the outer ring and referring to FIG. 3, additional tobacco 44 is placed in the pipe bowl 36, preferably to its top and tamped again in the same manner to compress the outer ring. Still additional tobacco 48 is then added to the pipe bowl 36 and tamped in the same manner to compress the outer ring of tobacco to provide a pack according to the invention. The upper convex surface 50 is then lit, preferably in a circle with a flame, and then retamped in the same manner pushing the ash 52 down, as illustrated in FIG. 4, so that it serves as a coke, as in a coal fire and also helps filter the smoke.

As illustrated in FIG. 4, tamping provides the upper surface 50 of the tobacco so that arcs extending from the pipe draw 38 to points on its upper surface 50 are substantially equidistant thereby providing a substantially even draw from all points on the tobacco's upper surface 50 which coupled with the compressed outer ring and uncompressed central portion provide substantially even burning and avoid the problems of prior art packs, such as tunneling, heeling, wetness and bitterness from a poor pack.

If desired, the surface 50 can be occasionally retamped in the manner described as the ash falls down in the air pockets in the unburned tobacco in the bowl and, preferably, the tobacco ash is not dumped out until completely burned, the ash serving to filter the smoke.

While not illustrated in FIGS. 2 and 3, points on the dome surrace 42 of FIG. 2 and on the dome surface 46 of FIG. 3 preferably are substantially equidistant from the draw 38 as in FIG. 4.

The pipe tamper of FIG. 5 is used in the same manner to tamp a pack in a pipe bowl as described in connection with the pipe tamper illustrated in FIG. 1.

The method of the invention comprises tamping the upper surface of tobacco in a pipe bowl into a compressed generally outer ring substantially devoid of air pockets with a substantially uncompressed or less compressed inner portion while having air pockets present in its central portion thereby providing slow burning of the central portion and fast burning of the outer ring, as illustrated in FIG. 2. This tamping results in a convex upper surface such that arcs extending from the draw opening to points of the upper surface are substantially equidistant. The method of tamping results in a substantially even draw from all points of the tobacco's upper surface and provides substantially even burning of the tobacco's upper surface thereby eliminating the problems of prior art tobacco packs, such as tunneling, heeling, wetness and bitterness due to the pack.

Preferably, the pipe bowl is partially filled with tobacco, about one-half full, and then its surface tamped into a compressed outer ring, as illustrated in FIG. 2. Additional tobacco is then added to the pipe bowl, preferably filling it, and the upper surface of the additional tobacco is again tamped into an outer compressed ring substantially devoid of air pockets and a central portion with air pockets, as illustrated in FIG. 3. Preferably, the pipe bowl is filled with still additional tobacco and its surface tamped adjacent the pipe bowl's inner surface into a compressed outer ring thereby forming its upper surface into a dome with the tobacco substantially devoid of air pockets at the outer ring and having air pockets present in its central portion which provides a slower burning central portion and a faster burning outer ring portion.

Preferably, the tamping is such that the upper surfaces of the tobacco at each tamping are convex so that arcs extending from the draw opening to points on their respective upper surfaces are substantially equidistant.

Preferably, the tobacco surface is lit with a flame completely over its surface by moving the flame in a circle over the tobacco's surface, and the lit surface is them retamped about its outer ring so that the tamped ash serves to coke the fire and the ash falling down in the airspaces or air pockets in the unburned tobacco serves to filter the smoke, as illustrated in FIG. 5.

Advantageously, the method of tamping tobacco in a pipe bowl may be accomplished by using the pipe tampers of FIG. 1 and FIG. 5, although any desired tamper can be used which is capable of tamping the tobacco pack according to the method of the invention.

Accordingly, the present invention accomplishes the objects and ends and has the features and advantages mentioned as well as others inherent therein.

While presently-preferred embodiments of the invention have been given for purposes of disclosure, changes may be made therein which are within the spirit of the invention as defined by the scope of the appended claims.

What is claimed is:

1. A pipe tamper for tamping tobacco in a pipe bowl having a draw opening in its bottom portion comprising, a handle, and a tamping head at one end of the handle having a face at an angle of from about 10° to about 65° to a plane extending at a right angle to a longitudinal line extending through the head, thereby providing the face with a leading edge and a trailing edge, the head portion being of a size to fit within the pipe bowl and to cover up to about one-half of the tobacco's upper surface, whereby tamping of the tobacco's upper surface with the leading edge adjacent the pipe bowl's inner surface while moving the pipe tamper around the inner surface compresses the tobacco at its outer edges substantially devoid of air pockets and leaves air pockets in its central portion.

2. The pipe tamper of claim 1 where the angle of the face is about 22.5°.

3. The pipe tamper of claim 2 where, the face of the tamping head is substantially planar.

4. The pipe tamper of claim 2 where, the face of the tamping head is concave.

5. The pipe tamper of claim 1 where, the face of the tamping head is at an angle which tamps the tobacco's upper surface so that arcs extending from the draw opening to points of the upper surface are substantially equidistant thereby providing a substantially even draw from all points of the tobacco's upper surface which provide substantially even burning of the tobacco's upper surface.

6. A method of tamping tobacco in a pipe bowl having a draw opening adjacent its bottom comprising, tamping the tobacco's upper surface so that arcs extending from the draw opening to points on the upper surface are substantially equidistant thereby providing a substantially even draw from all points of the tobacco's upper surface which provides substantially even burning thereof.

7. The method of claim 6 comprising, adding at least one time additional tobacco to the pipe bowl having the tamped tobacco, and tamping the additional tobacco's upper surface so that arcs extending from the draw opening to points on the upper surfaces of the tobacco and additional tobacco are substantially equidistant.

tamping with a tamper having a tamping face at an angle of from about 10° to about 65° to a plane extending at right angles to the axis of the head and which tamping face covers up to about one-half of the tobacco's upper surface.

8. A method of tamping tobacco in a pipe bowl having a draw opening at its bottom comprising, filling a portion of the pipe bowl with tobacco, tamping the tobacco's upper surface adjacent the pipe bowl's inner surface into a compressed outer ring substantially devoid of air pockets and having air pockets present in its central portion, adding at least one time additional tobacco to the pipe bowl having the tamped tobacco, tamping the additional tobacco's upper surface adjacent the pipe bowl's inner surface into a compressed outer ring substantially devoid of air pockets at the outer ring and having air pockets present in its central portion, thereby providing a slower-burning central portion and a faster burning outer ring to provide an even burn from all points of the tobacco's surface, lighting the tobacco's surface with a flame, and retamping the resulting ash on the tobacco's surface so it acts to coke the fire and the ash falls down in the air pockets in the tobacco thereby filtering the smoke.

9. The method of claim 8, including tamping with a tamping head having a tamping face at an angle of from about 10° to about 65° to a plane extending at a right angle to the axis of the head and which tamping face covers up to one-half the tobacco's surface.

10. The method of claim 8, including tamping the upper surfaces of the tobacco and of the additional tobacco so that arcs extending from the pipe draw to points on their upper surfaces are substantially equidistant thereby providing a substantially even draw from all points on the upper surface of the additional tobacco.

* * * * *